US005111937A

United States Patent [19]

Schutz

[11] Patent Number: 5,111,937

[45] Date of Patent: May 12, 1992

[54] PALLET CONTAINER

[76] Inventor: Udo Schutz, Ruckersteg 4, D-5418 Selters, Fed. Rep. of Germany

[21] Appl. No.: 659,450

[22] Filed: Feb. 22, 1991

[30] Foreign Application Priority Data

Feb. 22, 1990 [DE] Fed. Rep. of Germany ..... 4005633

[51] Int. Cl.[5] ..... B65D 19/00

[52] U.S. Cl. ..... 206/386; 206/596; 206/585; 206/592

[58] Field of Search ..... 206/386, 585, 591, 592

[56] References Cited

U.S. PATENT DOCUMENTS

| | | | |
|---|---|---|---|
| 4,676,373 | 6/1987 | Schneider | 206/386 |
| 4,909,387 | 3/1990 | Schutz | 206/386 |
| 4,930,661 | 6/1990 | Voohies | 206/386 |
| 4,947,988 | 8/1990 | Schutz | 206/386 |
| 5,002,194 | 3/1991 | Nichols | 206/386 |
| 5,029,734 | 7/1991 | Nichols | 206/386 |

*Primary Examiner*—William I. Price
*Attorney, Agent, or Firm*—Young & Thompson

[57] ABSTRACT

The pallet container, developed with the objective of increased transport and accident safety, exhibits a steel tube pallet (2), a supporting shell (3) of a synthetic resin, resting on the pallet, a synthetic-resin inner container (4) seated with its bottom section (5) in the supporting shell in a shape-mating fashion, as well as an outer container (6) of steel sheet supporting the inner container (4). The supporting shell (3), which assumes, besides the constant supporting function for the inner container (4), the function of a vibration damping means upon the occurence of sonar vibrations that can be triggered during transport by the liquid in the inner container (4) and the function of a shock absorber in an accident situation, exhibits a continuously extending outer, hollow supporting collar (24) with a supporting trough (26) curved inwardly on the underside (25) and with supporting troughs (29, 30) arranged on the underside (28) of the shell bottom (27) and extending longitudinally and transversely, these troughs being formed by hollow ribs (31, 32) molded to the shell bottom (27). The supporting shell (3) rests with the supporting trough (26) on the supporting collar (24) as well as with the longitudinally and transversely extending supporting troughs (29) at the underside of the shell bottom (27) on the upper tubular frame (23) of the steel tube pallet (2).

10 Claims, 2 Drawing Sheets

PALLET CONTAINER

The invention relates to pallet containers for the transport and storage of liquids, with an inner container of a synthetic resin with respectively one sealable filling and outlet opening, an outer container of steel sheet, supporting the synthetic-resin inner container, with respectively one access hole in the lid and in the jacket to the filling opening and to the outlet opening of the inner container, or with a lattice cage of intersecting vertical and horizontal lattice bars of metal, supporting the inner container, as well as with a carrying member supporting the inner container on a pallet, having a vibration-damping and shock absorber function.

The inner container of a synthetic resin of such pallet containers according to DE 25 45 023 C2 and DE 38 19 911 A1 is supported on a sheet-metal bottom, resting on the pallet, of the outer container or, respectively, of the lattice cage by way of a ring of polystyrene foam inserted between the bottom section of the inner container, exhibiting rounded outer edges, and the outer container of steel sheet or, respectively, the lattice cage of metal bars. In addition to the supporting function, the polystyrene foam ring has the function of a vibration-damping means against the sonic vibrations emanating during transport of liquid filling material, and of a shock absorber in accident situations, for example when the pallet container is dropped from a certain height.

In case the pallet container is subjected to vibration stress as well as impact stress, the damping effect of the supporting ring of polystyrene foam is not satisfactory. With high impact and shock stresses, there is the danger that the supporting ring is damaged to such an extent that it can no longer fulfill the supporting and damping function with which it is entrusted.

The invention is based on the object of structurally simplifying the pallet container of this type, with the sheet-metal bottom mounted on the pallet as a carrying means for the inner container, and with the polystyrene foam ring supporting this container, the desirable feature being a good damping capability in case of a vibration stress as well as in case of an impact and shock stress on the pallet container, with a view toward transport safety.

The pallet container of this invention is distinguished by the following advantages:

By the use of an elastic supporting shell of a synthetic resin, comprising hollow chambers, with a good damping capability in case of vibration stress as well as impact or shock stress on the pallet container, the latter satisfies the high requirements with respect to transport and accident safety to the full extent. The supporting shell renders the sheet-metal bottom superfluous, which bottom is mounted in the conventional pallet containers on the pallet as a support for the inner container, and eliminates the polystyrene foam ring supporting this inner container, so that a structural simplification is obtained and, along therewith, the manufacture of the pallet container is made more economical. Finally, a polyethylene plastic can be utilized for producing the blow-molded supporting shell, this plastic being obtained as a recycling material from the polyethylene inner container of the pallet container which latter is utilized as a disposable or multiple-trip container. This manufacturing feature makes it possible to save material for the pallet container and contributes toward relief of the burden on the environment since the plastic material of the inner container will not be deposited in a waste dump.

The invention will be described in greater detail below with reference to an embodiment of a pallet container illustrated in the drawings wherein.

Figure 1:
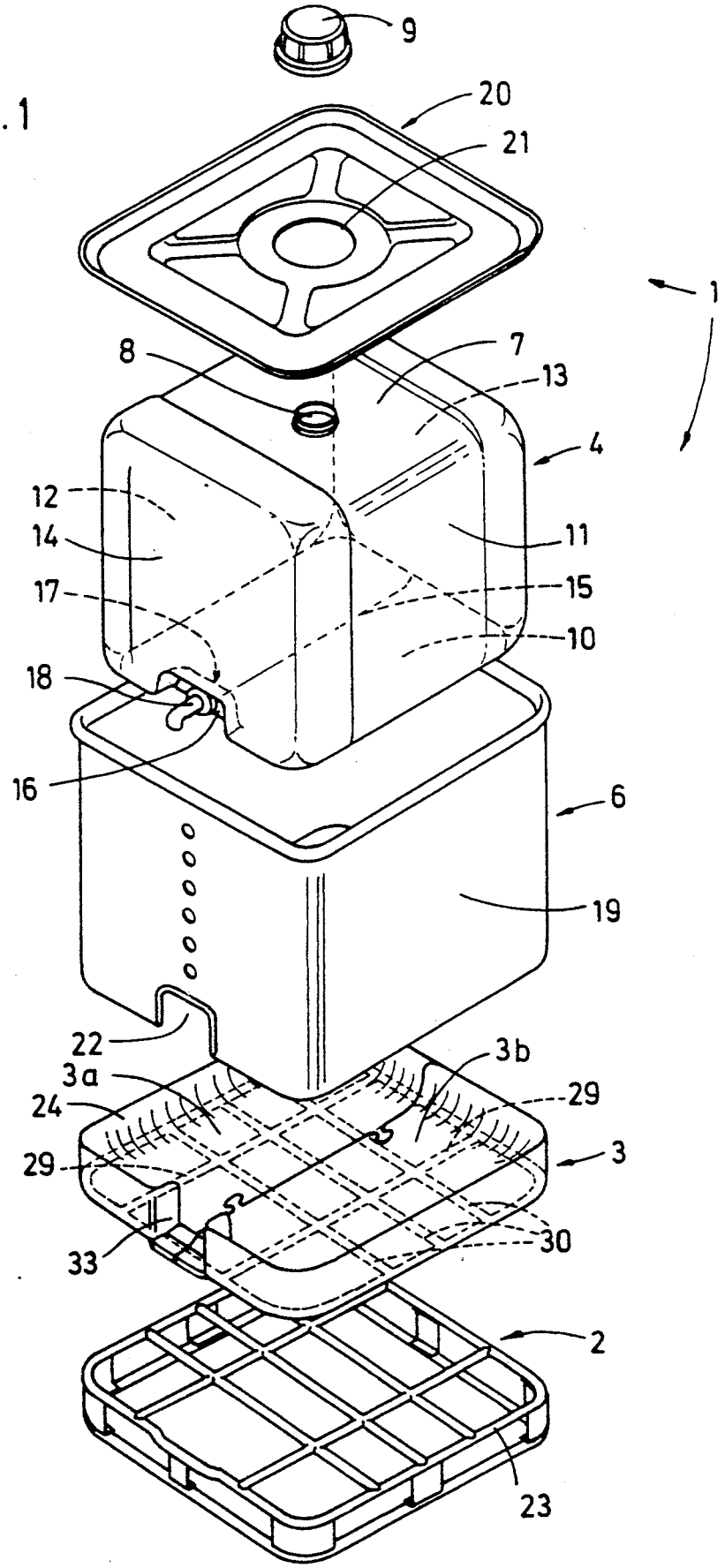
FIG. 1 is an exploded view of a pallet container with a steel tube pallet.
Figure 2:
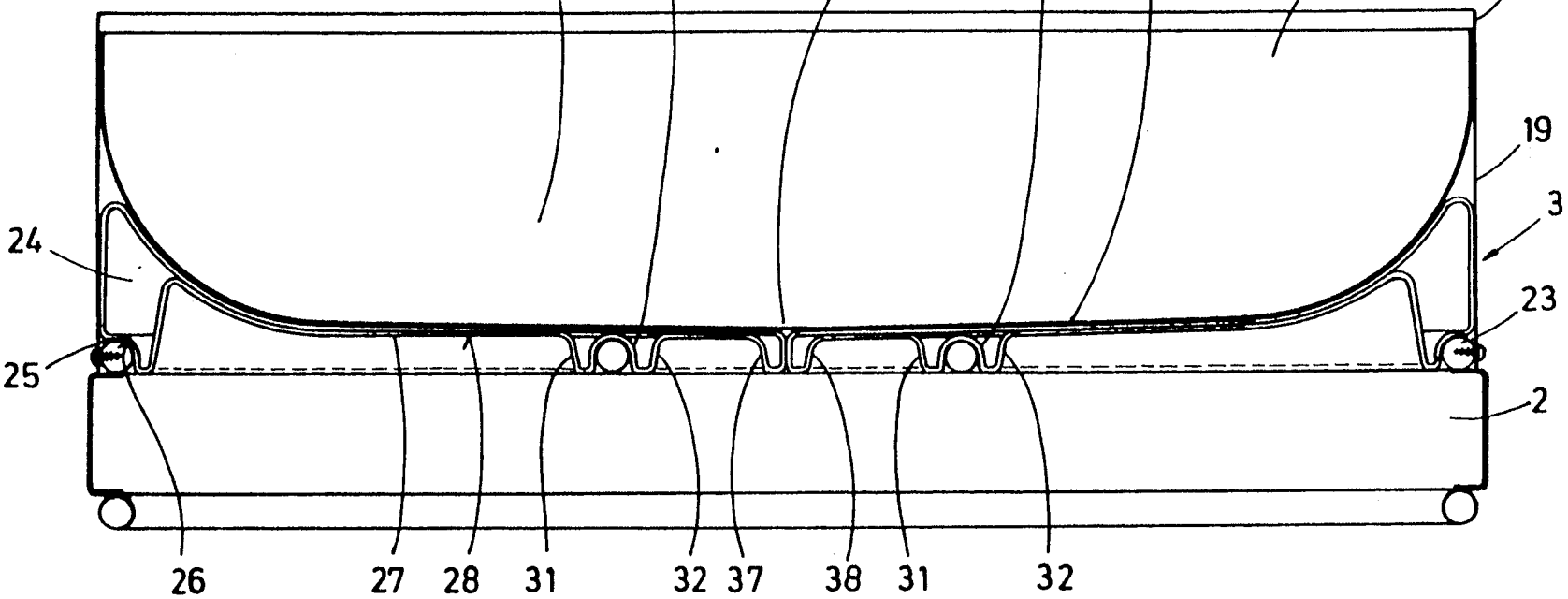
FIG. 2 is a section through the bottom region of the pallet container.
Figure 3:
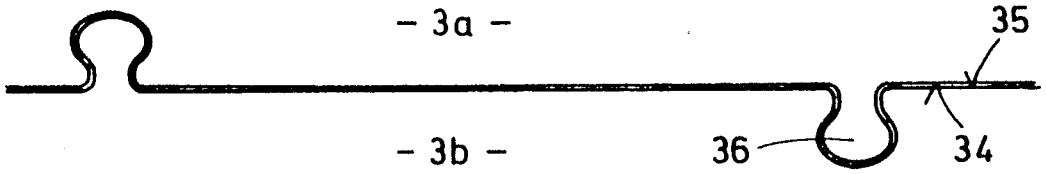
FIG. 3 shows the connection of the two shell halves of a divided supporting shell for the inner container in a fragmentary, enlarged top view.

The primary components of the pallet container 1 according to FIGS. 1 and 2 are a steel tube pallet 2 which can be picked up and transported from all four sides, a bipartite supporting shell 3 of a synthetic resin, preferably polyethylene, resting on the steel tube pallet, a synthetic-resin inner container 4, likewise of polyethylene, which is seated with its bottom section 5 in a shape-mating fashion in the supporting shell 3, as well as an outer container 6 of steel sheet supporting the inner container 4.

The inner container 4, blow-molded of polyethylene, with a rectangular contour and rounded corners, exhibits in the center of its topside 7 a filling opening 8 which is sealed with a screw lid 9 or with a plastic cleated lid. The bottom 10 of the inner container 4 descends from two oppositely located sidewalls 11, 12 of the container 4 slightly toward the center of the bottom and furthermore shows a slight gradient from the rearward 13 to the forward container wall 14. In this way, the bottom 10 of the inner container 4 forms a shallow drainage channel 15 slightly inclined toward the front wall 14 of the container 4, this channel terminating in an outlet opening 17 located in a vaulted portion 16 of the front wall 14; after removal of a screw cap, a drainage fitting 18 can be threaded onto this outlet opening.

In the zones of the filling opening 8 and the outlet opening 17 of the inner container 4, the lid 20, attached to the sheet-metal jacket 19 of the outer container 6 by seam welding, and the sheet-metal jacket 19 exhibit corresponding access openings 21, 22. The sheet-metal jacket 19 of the outer container 6 encompassing the inner container 4 and the supporting shell 3 is attached to the steel tube pallet 2, preferably by being screw-connected to the upper tube frame 23 of the steel tube pallet 2.

The elastic supporting shell 3 which takes over, besides the constant bearing function for the inner container 4, the function of a vibration damping means upon the occurrence of sonic vibrations that can be triggered during transport by the liquid in the inner container 4, and the function of a shock absorber in an accident situation, for example when the pallet container is dropped from a certain height or in case of a collision of the transport vehicle with another vehicle, exhibits a continuously extending outer, hollow supporting collar 24 with a supporting trough 26 curved inwardly on the underside 25 and with longitudinally and transversely extending supporting troughs 29, 30 arranged on the underside 28 of the shell bottom 27, which latter troughs are formed by hollow ribs 31, 32 molded to the shell bottom 27. The supporting shell 3 rests with the supporting trough 26 on the supporting collar 24 as well as with the longitudinally and transversely extending supporting troughs 29, 30 at the underside of the shell bottom 27 on the upper tubular frame 23 of the steel tube pallet 2.

The outer supporting collar 24 of the supporting shell 3 exhibits an opening 33 for the drain fitting 18 of the inner container 4.

For reasons of manufacturing technique, the supporting shell 3 consists of two halves *3a, 3b* joined in shape-mating fashion by means of hook catches 36 arranged on their abutting edges 34, 35.

In the region of the abutting edges 34, 35 of the two shell halves *3a, 3b*, two further hollow ribs 37, 38 are molded to the underside 28 of the shell bottom 27 in order to rigidify the shell bottom.

A further measure for increasing the stiffness of the supporting shell 3 resides in providing the hollow parts molded onto the shell bottom 27, such as the outer supporting collar 24 and the ribs 29, 30, 37, 38, with a synthetic resin foam filling.

In place of a steel tube pallet, the pallet container can be equipped with a wooden pallet. The sheet-metal jacket of the outer container can be exchanged for a lattice cage.

The pallet container is usable as a one-way container as well as a multiple-trip container.

What is claimed is:

1. In a pallet container for the transport and storage of liquids, with an inner container of a synthetic resin with sealable filling and outlet openings, an outer container supporting the synthetic-resin inner container, with an access hole in a lid of the outer container to the filling opening and another access hole in the outer container to the outlet opening of the inner container, and a carrying member supporting the inner container on a pallet, having a vibration-damping and shock absorber function; the improvement wherein the carrying member is an elastic supporting shell (3) of a synthetic resin which accommodates in shape-mating fashion a bottom section (5) of the inner container (4) and rests, with a continuously extending outer, hollow supporting collar (24), with an inwardly curved supporting through (26) on its underside (25), and with longitudinally and transversely extending supporting troughs (29, 30), arranged on the underside (28) of a bottom (27) of the shell and formed by hollow ribs (31, 32) molded to the shell bottom (27), on an upper frame (23) of said pallet (2), said outer supporting collar (24) having an opening (33) for a drain fitting (18) of the inner container (4) from said outlet opening.

2. Pallet container according to claim 1, wherein the supporting shell (3) is blow-molded from a synthetic resin.

3. Pallet container according to claim 1, further comprising hollow ribs (37, 38), molded onto the underside (28) of the shell bottom (27), for rigidifying the shell bottom (27).

4. Pallet container according to claim 1, wherein the outer supporting collar (24) and the troughs (29, 30) are hollow and are filled with synthetic resin foam.

5. Pallet container according to claim 1, wherein the supporting shell (3) has the shape of the inner container (4) and is polygonal.

6. Pallet container according to claim 1, wherein said upper frame (23) is tubular.

7. Pallet container according to claim 1, wherein said supporting shell (3) is in several parts (*3a, 3b*).

8. Pallet container according to claim 7, in which said several parts (*3a, 3b*) of the support shell (3) are interlockingly joined in a shape-mating fashion.

9. Pallet container according to claim 1, wherein said pallet (2) is of tubular metal construction.

10. Pallet container according to claim 1, wherein said pallet (2) is of wood.

* * * * *